US011576536B1

(12) United States Patent
Gunia

(10) Patent No.: US 11,576,536 B1
(45) Date of Patent: Feb. 14, 2023

(54) FINGER MOISTENING ASSEMBLY

(71) Applicant: Megan Gunia, Manistee, MI (US)

(72) Inventor: Megan Gunia, Manistee, MI (US)

( * ) Notice: Subject to any disclaimer, the term of this patent is extended or adjusted under 35 U.S.C. 154(b) by 0 days.

(21) Appl. No.: 17/482,072

(22) Filed: Sep. 22, 2021

(51) Int. Cl.
*B05C 21/00* (2006.01)
*A47K 5/12* (2006.01)

(52) U.S. Cl.
CPC ..... *A47K 5/1217* (2013.01); *A47K 5/1202* (2013.01); *A47K 2201/00* (2013.01)

(58) Field of Classification Search
CPC ..... A47K 5/1217; A47K 5/1202; A47K 2201/00; A47K 5/1211
See application file for complete search history.

(56) References Cited

U.S. PATENT DOCUMENTS

| | | | | |
|---|---|---|---|---|
| 4,953,815 | A | 9/1990 | Beymer | |
| 5,921,512 | A | 7/1999 | Torres | |
| 6,874,697 | B2 | 4/2005 | Callueng | |
| 10,214,047 | B1 | 2/2019 | Haggarty | |
| 10,926,283 | B2 | 2/2021 | Jordan | |
| 2003/0202838 | A1 | 10/2003 | Sun | |
| 2010/0147974 | A1 | 6/2010 | Cunningham | |
| 2011/0263402 | A1 | 10/2011 | Booher | |
| 2013/0134183 | A1* | 5/2013 | Van Diepen | A47K 5/1217 222/52 |
| 2014/0232319 | A1* | 8/2014 | Wegelin | A47K 5/1217 320/101 |
| 2014/0263428 | A1* | 9/2014 | Brown | A47K 5/1217 222/52 |
| 2015/0083754 | A1* | 3/2015 | Proper | B67D 3/0029 222/180 |
| 2018/0235409 | A1* | 8/2018 | Ciavarella | A47K 5/1217 |

FOREIGN PATENT DOCUMENTS

| | | | | |
|---|---|---|---|---|
| CN | 112155460 A | * | 1/2021 | A47K 5/1211 |
| CN | 112603183 A | * | 4/2021 | |
| CN | 213282681 U | * | 5/2021 | |
| CN | 113440037 A | * | 9/2021 | |
| CN | 214342031 U | * | 10/2021 | |
| DE | 202020102398 U1 | * | 6/2020 | |

* cited by examiner

*Primary Examiner* — Bob Zadeh

(57) ABSTRACT

A finger moistening assembly for moistening a user's fingertips includes a housing that has a hand space integrated into the housing to accommodate a user's hand. The housing is fillable with a saline solution. A pump is integrated into the housing to spray a predetermined volume of the saline solution into the hand space when the pump is turned on to moisten the user's fingertips. A motion sensor is integrated into the shelf portion and the pump is turned on when the motion sensor senses motion. A stand is provided and the stand is positionable on a support surface. The housing is attachable to the stand such that the housing is accessible to the user.

7 Claims, 7 Drawing Sheets

FINGER MOISTENING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to moistening devices and more particularly pertains to a new moistening device for moistening a user's fingertips. The device includes a housing that contains a saline solution and a pump that is integrated into the housing. The pump delivers a predetermined volume of the saline solution onto a user's fingertips to moisten the user's fingertips for enhancing grip of the user's fingertips. The device includes a stand that has an adjustable height and the housing is attachable to the stand.

(2) Description of Related Art Including Information Disclosed Under 37 CFR 1.97 and 1.98

The prior art relates to moistening devices including a disinfectant sprayer for spraying disinfectant on a door knob. The prior art discloses a finger moistening device that includes a tray which contains a fluid to facilitate a user to dip their fingertips into the fluid. The prior art discloses a spraying device for delivering a misted liquid onto a user's fingertips. The prior art discloses a fingertip moistener that includes an applicator for applying a liquid to a user's fingertips. The prior art discloses a moistening device that applies a misted liquid onto plastic bags for enhancing opening the plastic bags.

BRIEF SUMMARY OF THE INVENTION

An embodiment of the disclosure meets the needs presented above by generally comprising a housing that has a hand space integrated into the housing to accommodate a user's hand. The housing is fillable with a saline solution. A pump is integrated into the housing to spray a predetermined volume of the saline solution into the hand space when the pump is turned on to moisten the user's fingertips. A motion sensor is integrated into the shelf portion and the pump is turned on when the motion sensor senses motion. A stand is provided and the stand is positionable on a support surface. The housing is attachable to the stand such that the housing is accessible to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
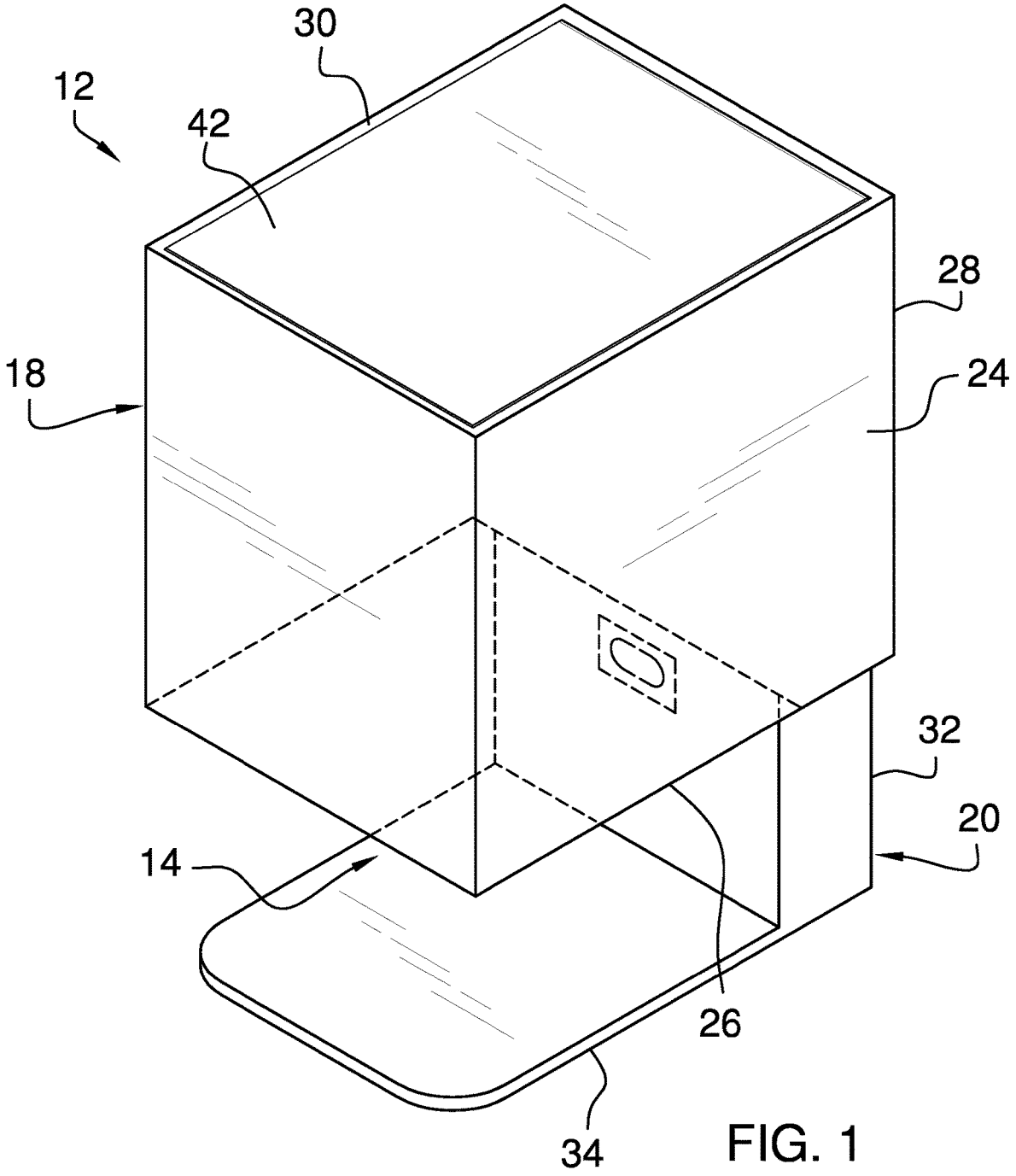
FIG. 1 is a phantom perspective view of a finger moistening assembly according to an embodiment of the disclosure.
Figure 2:
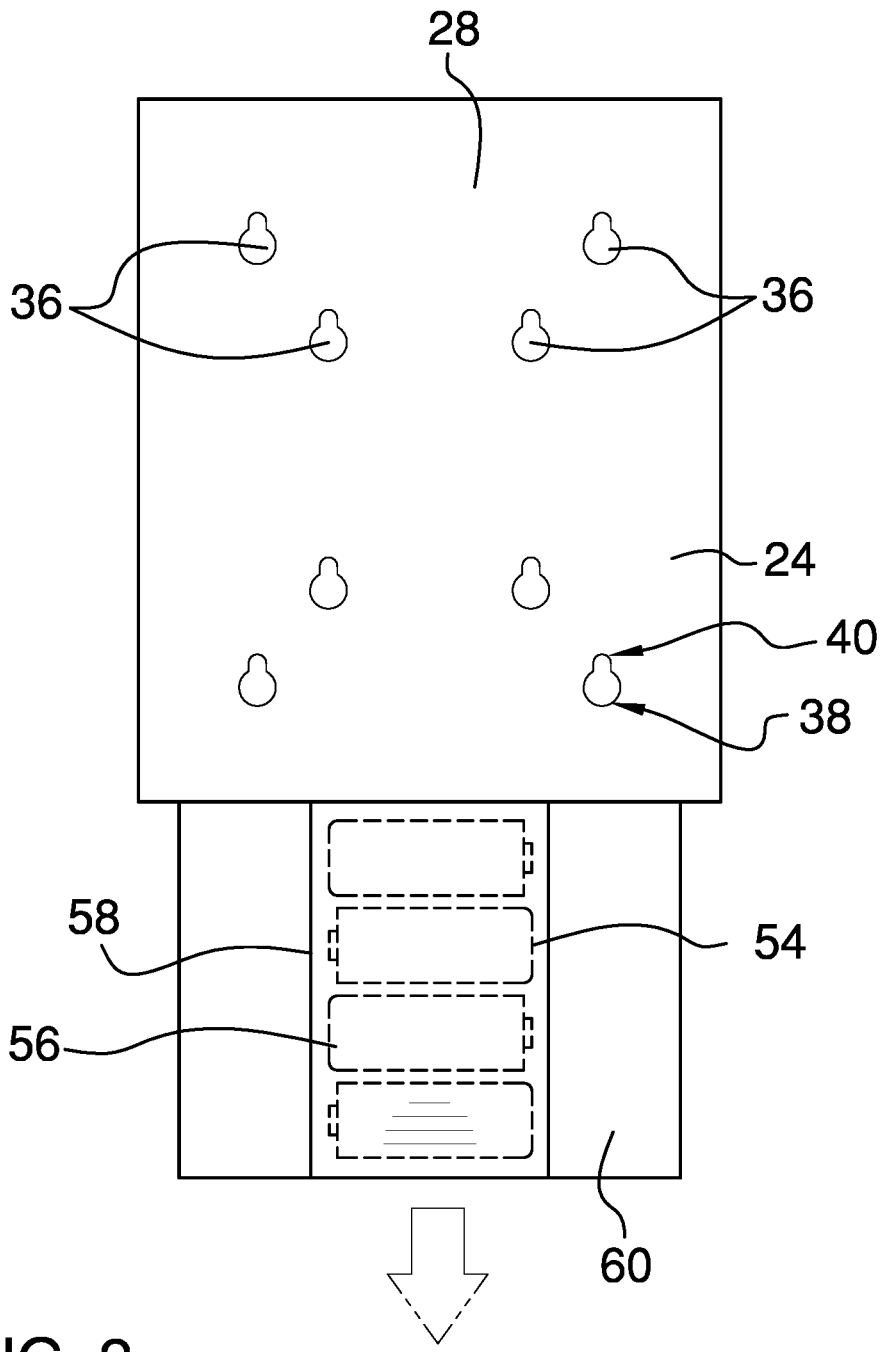
FIG. 2 is a back view of an embodiment of the disclosure.
Figure 3:
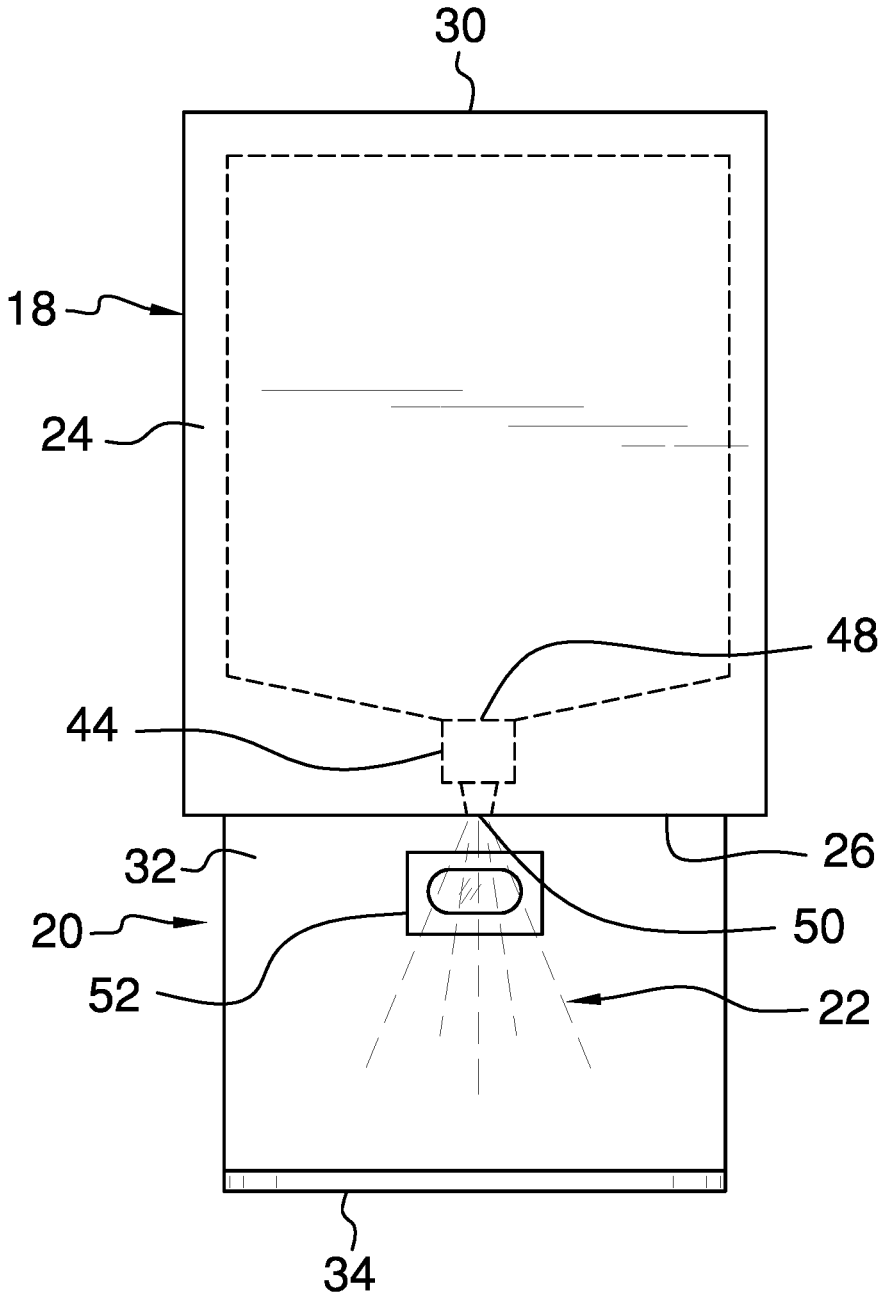
FIG. 3 is a front phantom view of an embodiment of the disclosure.
Figure 4:
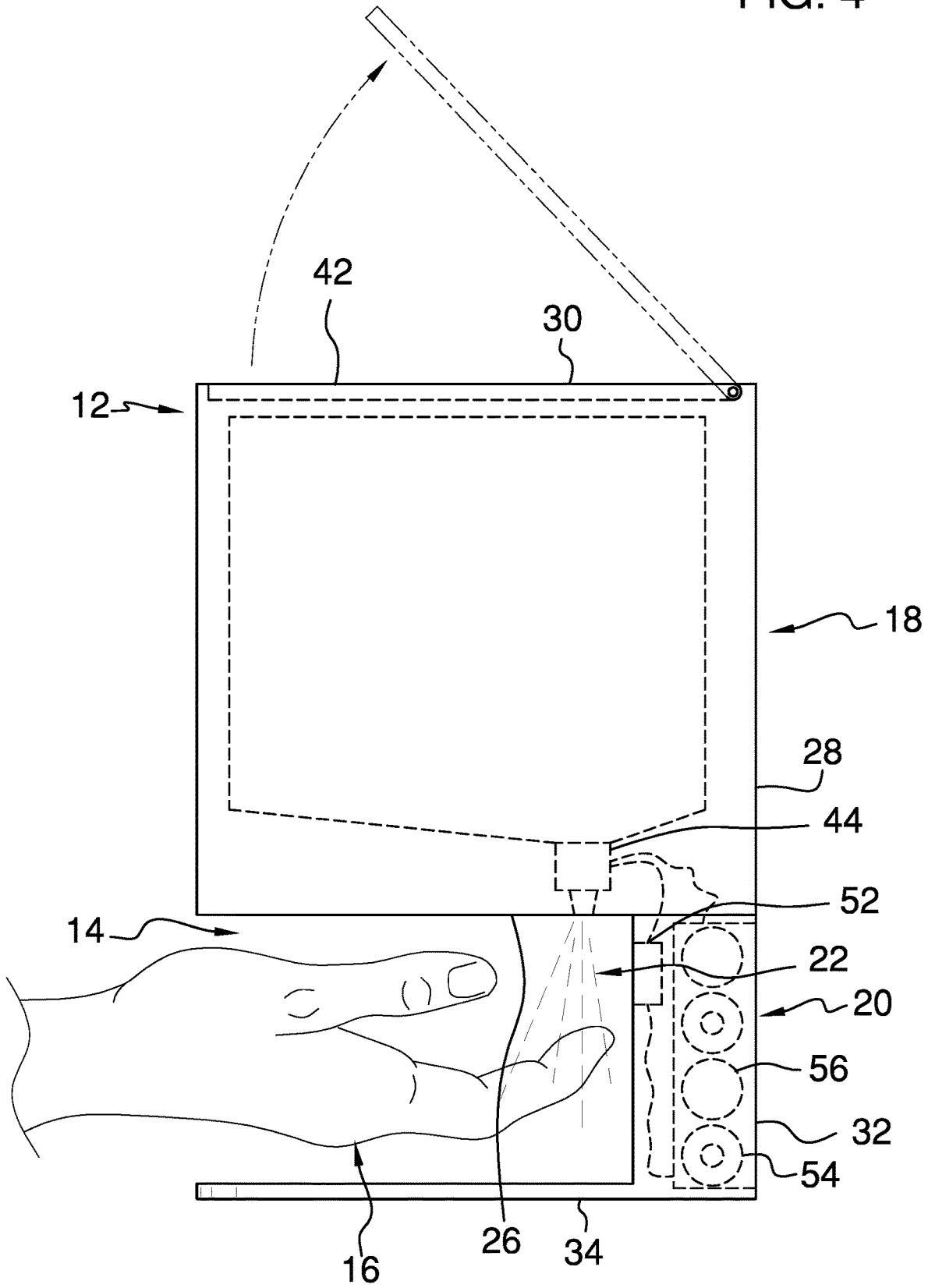
FIG. 4 is a left side phantom view of an embodiment of the disclosure.
Figure 5:
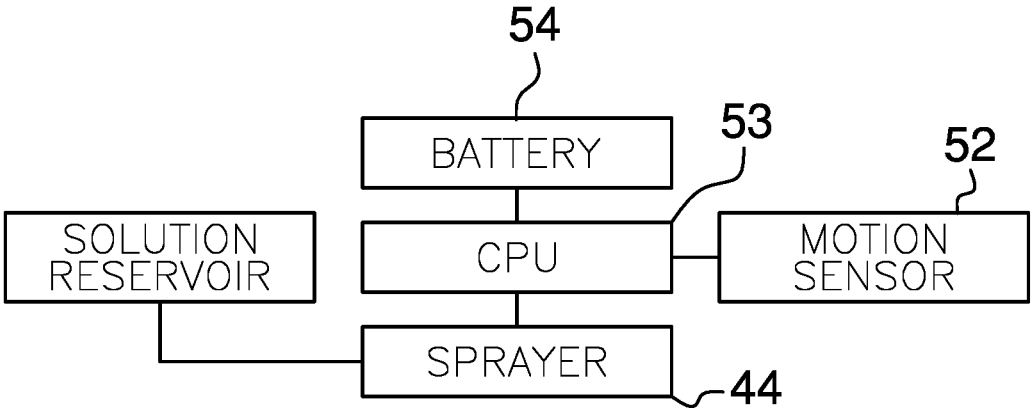
FIG. 5 is a schematic view of an embodiment of the disclosure.
Figure 6:
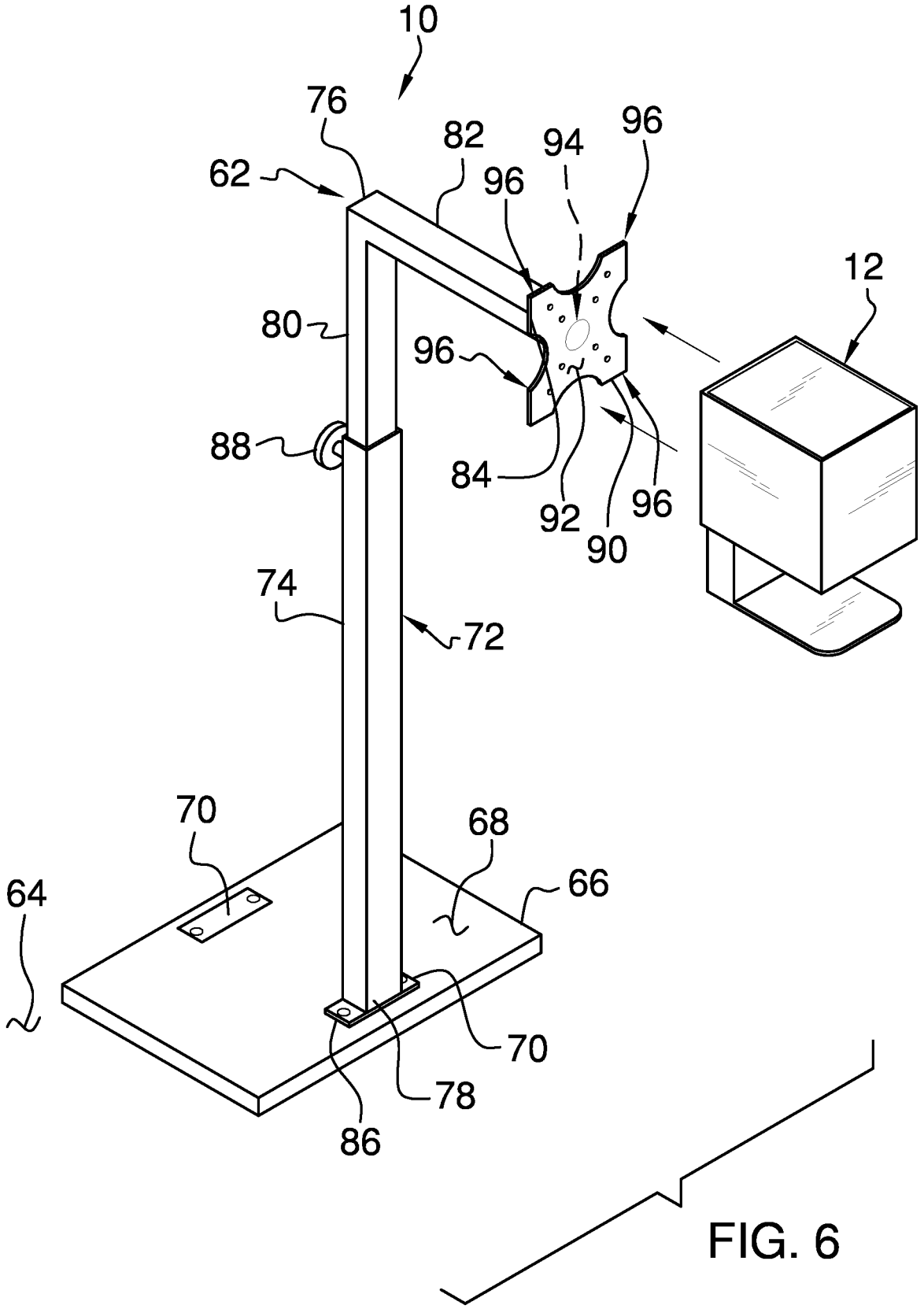
FIG. 6 is a perspective view of a stand of an embodiment of the disclosure.

With reference now to the drawings, and in particular to FIGS. 1 through 7 thereof, a new moistening device embodying the principles and concepts of an embodiment of the disclosure and generally designated by the reference numeral 10 will be described.

As best illustrated in FIGS. 1 through 7, the finger moistening assembly 10 generally comprises a housing 12 that has a hand space 14 that is integrated into the housing 12 to accommodate a user's hand 16. The housing 12 has a reservoir portion 18 and a shelf portion 20, and the reservoir portion 18 is fillable with a saline solution 22. The reservoir portion 18 has an outer wall 24 and the outer wall 24 has a bottom side 26, a back side 28 and a top side 30. The top side 30 is open to access an interior of the reservoir portion 18. The shelf portion 20 has a vertical wall 32 extending downwardly from the bottom side 26 of the outer wall 24, and the vertical wall 32 is aligned with the back side 28 of the outer wall 24. The shelf portion 20 has a horizontal wall 34 extending forwardly from the vertical wall 32. The horizontal wall 34 is spaced from the bottom side 26 of the outer wall 24 to define the hand space 14 between the horizontal wall 34 and the bottom side 26 of the outer wall 24.

The back side 28 of the outer wall 24 has a plurality of fastener holes 36 each extending through the back side 28. The plurality of fastener holes 36 is arranged into a plurality of lines radiating from a center of the back side 28. Each of the fastener holes 36 has a rounded portion 38 and a channel portion 40, and the rounded portion 38 has a diameter that is greater than the width of the channel portion 40. A lid 42 is hingedly coupled to the housing 12 for opening and closing the housing 12, and the lid 42 is positioned on the top side 30 of the outer wall 24 of the housing 12. The lid 42 closes the top side 30 when the lid 42 is closed and the lid 42 exposes the top side 30 when the lid 42 is opened.

A pump 44 is integrated into the housing 12 and the pump 44 is in fluid communication with the reservoir portion 18 such that the pump 44 receives the saline solution 22 in the reservoir portion 18. The pump 44 sprays a predetermined volume of the saline solution 22 into the hand space 14 when the pump 44 is turned on to moisten the user's fingertips 46. In this way the user can enhance the grip of their fingers without having to lick their fingers. Thus, the likelihood of transferring infectious diseases by touch is reduced by eliminating the need for the user to lick their fingers.

The pump 44 has an intake 48 and an exhaust 50, and the pump 44 is integrated into the bottom side 26 of the outer wall 24 of the reservoir portion 18 of the housing 12. The intake 48 is positioned in the reservoir portion 18 and the exhaust 50 is directed downwardly toward the horizontal wall 34 of the shelf portion 20. Furthermore, the exhaust 50 sprays the saline solution 22 toward the horizontal wall 34 when the pump 44 is turned on. The pump 44 may be an electric fluid pump or the like and the exhaust 50 may include an atomizer to convert the saline solution 22 into a mist.

A motion sensor 52 is integrated into the shelf portion 20 to sense motion of the user's hand 16 when the user inserts their hand into the hand space 14. The motion sensor 52 is in communication with the pump 44 and the pump 44 is turned on when the motion sensor 52 senses motion. The motion sensor 52 is integrated into the vertical wall 32 of the shelf portion 20 and the motion sensor 52 is oriented to face into the hand space 14. Additionally, the motion sensor 52 is electrically coupled to the pump 44 and the motion sensor 52 may comprise an electronic motion sensor 52 with an operational range of less than 1.0 feet. The motion sensor 52 might include a control circuit 53 that is in electrical communication with the pump 44.

A power supply 54 is integrated into the vertical wall 32 of the shelf portion 20 of the housing 12. The power supply 54 is electrically coupled to the motion sensor 52 and the power supply 54 comprises at least one battery 56. A battery cover 58 is removably attached to a back side 60 of the vertical wall 32 of the shelf portion 20 of the housing 12. The power supply 54 is positioned beneath the battery cover 58 for removing and replacing the at least one battery 56.

A stand 62 is provided and the stand 62 is positionable on a support surface 64. The housing 12 is mountable to the stand 62 such that the housing 12 is elevated to a convenient height for the user. The support surface 64 may be a counter top or table top located at a checkout line of a grocery store, for example, or other location that is commonly occupied by a variety of different people. The stand 62 comprises a base 66 that has a top surface 68 and the top surface 68 has a pair of connection points 70 that is each integrated into the top surface 68. The connection points 70 are positioned on opposite sides of the base 66 from each other.

The stand 62 includes an arm 72 that has a first portion 74 which slidably engages a second portion 76 such that the arm 72 has a telescopically adjustable height. The first portion 74 has a bottom end 78 and the second portion 76 has a first section 80 forming an angle with a second section 82. The first portion 74 slidably engages the first section 80 such that the second section 82 is oriented perpendicular to the first portion 74, and the second section 82 has a distal end 84 with respect to the first section 80. The stand 62 includes an attachment 86 that is coupled to the bottom end 78 of the first portion 74. The attachment 86 releasably engages a respective one of the connection points 70 in the top surface 68 of the base 66.

The stand 62 includes a screw 88 that extends through the first portion 74 of the arm 72. The screw 88 engages the first section 80 of the second portion 76 of the arm 72 when the screw 88 is tightened for retaining the arm 72 at a selected height. The stand 62 includes a plate 90 which has a front surface 92 and a back surface 94, and the back surface 94 is coupled to distal end 84 of the second section 82 of the second portion 76 of the arm 72. The plate 90 is structured to define a plurality of arms 96 each radiating outwardly from a center of the plate 90.

The stand 62 includes a plurality of fasteners 98 that each comprises a stem 100 extending away from the front surface 92 of the plate 90 and a head 102 that is coupled to the stem 100. The plurality of fasteners 98 is spaced apart from each other and is distributed along a respective one of the arms 96 defined on the plate 90. In this way the plurality of fasteners 98 is arranged in a manner that matches the arrangement of the fastener holes 36 in the back side 28 of the outer wall 24 of the reservoir portion 18 of the housing 12. The head 102 of each of the fasteners 98 is extendable through the rounded portion 38 of a respective one of the fastener holes 36 and the stem 100 of each of the fasteners 98 slides into the channel portion 40 of the respective fastener hole 36. In this way the plate 90 is secured to the back side 28 of the outer wall 24 of the reservoir portion 18.

Figure 7:
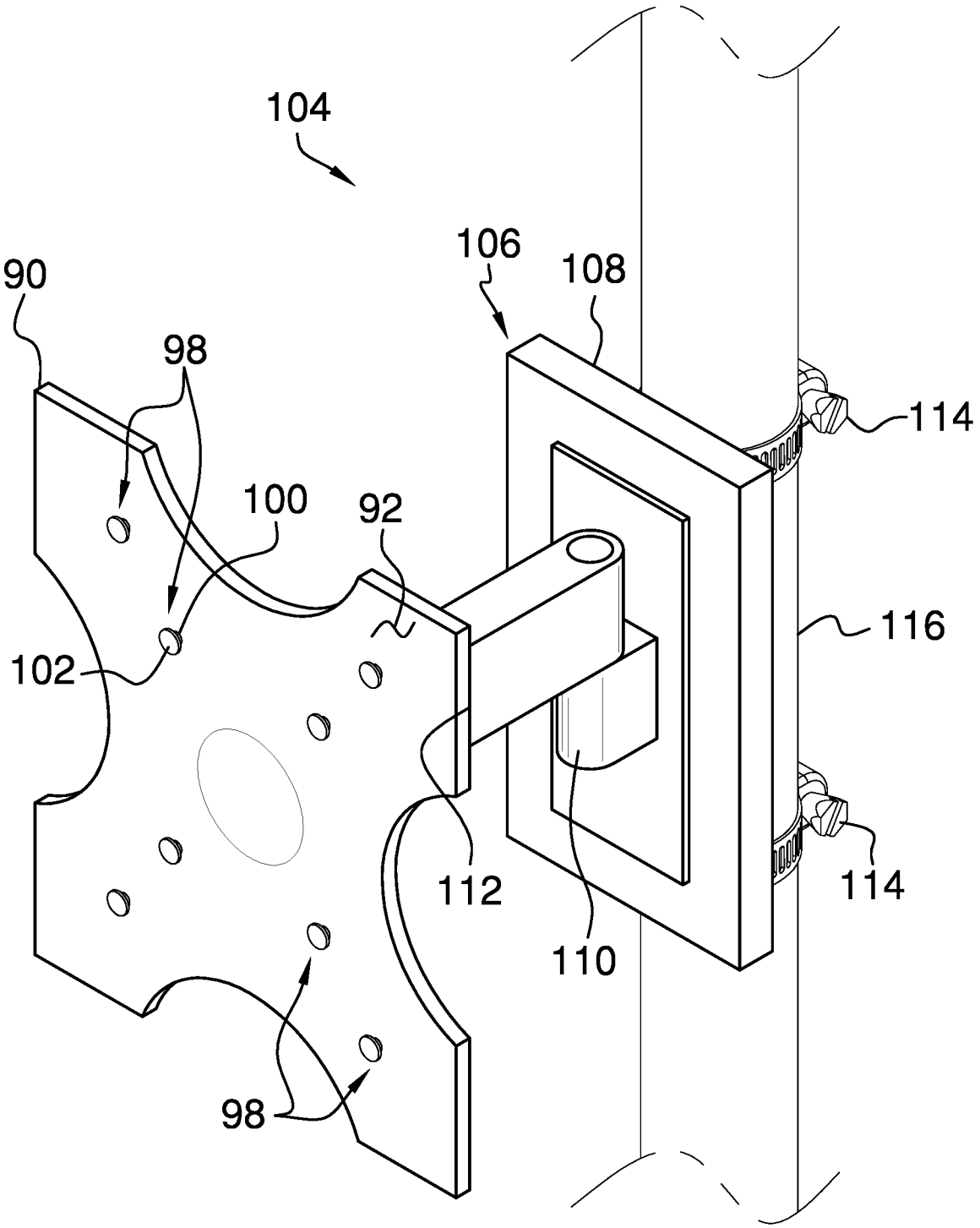
FIG. 7 is a perspective view of an alternative embodiment of the disclosure.

In an alternative embodiment 104 as is most clearly shown in FIG. 7, a mounting bracket 106 may be provided that includes a mounting plate 108 and a hinged arm 110 that extends away from the mounting plate 108. The plate 90 may be attached to a distal end 112 of the hinged arm 110 such that the housing 12 can be attached to the mounting bracket 106. A pair of hose clamps 114 may each be attached to the mounting plate 108. Each of the hose clamps 114 may be attachable around a stanchion 116 for mounting the mounting bracket 106 to the stanchion 116.

In use, the reservoir portion 18 is filled with the saline solution 22 and user inserts their hand 16 into the hand space 14 when the user wishes to moisten their fingertips 46. The motion sensor 52 senses the motion of the user's hand 16 and the pump 44 is turned on to pump the predetermined volume of saline solution 22 onto the user's fingertips 46. In this way the user's fingertips 46 can be moistened without requiring the user to lick their fingertips 46. Thus, the user is inhibited from transferring infectious disease by touch that could potentially result from repeatedly licking their fingertips 46. The user can moisten their fingertips 46 to enhance their ability to grip objects, such as paper bags for example, in order to manipulate the objects.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A finger moistening assembly for moistening a user's fingers to enhance the user's grip, said assembly comprising:

a housing having a hand space being integrated into said housing wherein said hand space is configured to accommodate a user's hand, said housing having a reservoir portion and a shelf portion, said reservoir portion being tillable with a saline solution;

a lid being hingedly coupled to said housing for opening and closing said housing;

a pump being integrated into said housing, said pump being in fluid communication with said reservoir portion such that said pump receives said saline solution in said reservoir portion, said pump spraying a predetermined volume of said saline solution into said hand space when said pump is turned on wherein said pump is configured to moisten the user's fingertips;

a motion sensor being integrated into said shelf portion wherein said motion sensor is configured to sense motion of the user's hand when the user inserts their hand into said hand space, said motion sensor being in communication with said pump, said pump being turned on when said motion sensor senses motion; and a stand being positionable on a support surface, said housing being attachable to said stand wherein said housing is configured to be accessible to the user, wherein said stand comprises:

a base having a top surface, said top surface having a pair of connection points each being integrated into said top surface, said connection points being positioned on opposite sides of said base from each other;

an arm having a first portion slidably engaging a second portion such that said arm has a telescopically adjustable height, said first portion having a bottom end, said second portion having a first section forming an angle with a second section, said first portion slidably engaging said first section such that said second section is oriented perpendicular to said first portion, said second section having a distal end with respect to said first section; and an attachment being coupled to said bottom end of said first portion, said attachment releasably engaging a respective one of said connection points in said top surface of said base.

2. The assembly according to claim 1, wherein:

said reservoir portion has an outer wall, said outer wall having a bottom side, a back side and a top side, said top side being open to access an interior of said reservoir portion, said shelf portion having a vertical wall extending downwardly from said bottom side of said outer wall, said vertical wall being aligned with said back side of said outer wall, said shelf portion having a horizontal wall extending forwardly from said vertical wall, said horizontal wall being spaced from said bottom side of said outer wall to define said hand space between said horizontal wall and said bottom side of said outer wall; and said lid is positioned on said top side of said outer wall of said housing, said lid closing said top side when said lid is closed, said lid exposing said top side when said lid is opened.

3. The assembly according to claim 2, wherein:

said pump has an intake and an exhaust, said pump being integrated into said bottom side of said outer wall of said reservoir portion of said housing, said intake being positioned in said reservoir portion, said exhaust being directed downwardly toward said horizontal wall of said shelf portion, said exhaust spraying said saline solution toward said horizontal wall when said pump is turned on; and said motion sensor is integrated into said vertical wall of said shelf portion, said motion sensor being oriented to face into said hand space, said motion sensor being electrically coupled to said pump.

4. The assembly according to claim 1, wherein said stand comprises a plate having a front surface and a back surface, said back surface being coupled to distal end of said second section of said second portion of said arm, said plate comprising a plurality of arms each radiating outwardly from a center of said plate.

5. The assembly according to claim 4, wherein:

said reservoir portion has an outer wall, a back side of said outer wall having a plurality of fastener holes each extending through said back side, said plurality of fastener holes being arranged into a plurality of lines radiating from a center of said back side, each of said fastener holes having a rounded portion and a channel portion, said rounded portion having a diameter being greater than the width of said channel portion; and said stand includes a plurality of fasteners, each of said fasteners comprising a stem extending away from said front surface of said plate and a head being coupled to said stem, said plurality of fasteners being spaced apart from each other and being distributed along a respective one of said arms defined on said plate, said head of each of said fasteners being extendable through said rounded portion of a respective one of said fastener holes in said back side of said outer wall of said reservoir portion of said housing, said stem of each of said fasteners sliding into said channel portion of said respective fastener hole for securing said plate to said back side of said outer wall of said reservoir portion.

6. A finger moistening assembly for moistening a user's fingers to enhance the user's grip, said assembly comprising:

a housing having a hand space being integrated into said housing wherein said hand space is configured to accommodate a user's hand, said housing having a reservoir portion and a shelf portion, said reservoir portion being finable with a saline solution;

a lid being hingedly coupled to said housing for opening and closing said housing;

a pump being integrated into said housing, said pump being in fluid communication with said reservoir portion such that said pump receives said saline solution in said reservoir portion, said pump spraying a predetermined volume of said saline solution into said hand space when said pump is turned on wherein said pump is configured to moisten the user's fingertips;

a motion sensor being integrated into said shelf portion wherein said motion sensor is configured to sense motion of the user's hand when the user inserts their hand into said hand space, said motion sensor being in communication with said pump, said pump being turned on when said motion sensor senses motion;

a stand being positionable on a support surface, said housing being attachable to said stand wherein said housing is configured to be accessible to the user;

wherein said reservoir portion has an outer wall, said outer wall having a bottom side, a back side and a top side, said top side being open to access an interior of said reservoir portion said shelf portion having a vertical wall extending downwardly from said bottom side of said outer wall, said vertical wall being aligned with said back side of said outer wall, said shelf portion having a horizontal wall extending forwardly from said vertical wall, said horizontal wall being spaced from said bottom side of said outer wall to define said hand space between said horizontal wall and said bottom side of said outer wall;

wherein said lid is positioned on said top side of said outer wall of said housing, said lid closing said top side when said lid is closed, said lid exposing said top side when said lid is opened; and wherein said back side of said outer wall has a plurality of fastener holes each extending through said back side, said plurality of fastener holes being arranged into a plurality of lines radiating from a center of said back side, each of said fastener holes having a rounded portion and a channel portion, said rounded portion having a diameter being greater than the width of said channel portion.

7. A finger moistening assembly for moistening a user's fingers to enhance the user's grip, said assembly comprising:

a housing having a hand space being integrated into said housing wherein said hand space is configured to accommodate a user's hand, said housing having a reservoir portion and a shelf portion, said reservoir portion being tillable with a saline solution, said reservoir portion having an outer wall, said outer wall having a bottom side, a back side and a top side, said top side being open to access an interior of said reservoir portion, said shelf portion having a vertical wall extending downwardly from said bottom side of said outer wall, said vertical wall being aligned with said back side of said outer wall, said shelf portion having a horizontal wall extending forwardly from said vertical wall, said horizontal wall being spaced from said bottom side of said outer wall to define said hand space between said horizontal wall and said bottom side of said outer wall, said back side of said outer wall having a plurality of fastener holes each extending through said back side, said plurality of fastener holes being arranged into a plurality of lines radiating from a center of said back side, each of said fastener holes having a rounded portion and a channel portion, said rounded portion having a diameter being greater than the width of said channel portion;

a lid being hingedly coupled to said housing for opening and closing said housing, said lid being positioned on said top side of said outer wall of said housing, said lid closing said top side when said lid is closed, said lid exposing said top side when said lid is opened;

a pump being integrated into said housing, said pump being in fluid communication with said reservoir portion such that said pump receives said saline solution in said reservoir portion, said pump spraying a predetermined volume of said saline solution into said hand space when said pump is turned on wherein said pump is configured to moisten the user's fingertips, said pump having an intake and an exhaust, said pump being integrated into said bottom side of said outer wall of said reservoir portion of said housing, said intake being positioned in said reservoir portion, said exhaust being directed downwardly toward said horizontal wall of said shelf portion, said exhaust spraying said saline solution toward said horizontal wall when said pump is turned on;

a motion sensor being integrated into said shelf portion wherein said motion sensor is configured to sense motion of the user's hand when the user inserts their hand into said hand space, said motion sensor being in communication with said pump, said pump being turned on when said motion sensor senses motion, said motion sensor being integrated into said vertical wall of said shelf portion, said motion sensor being oriented to face into said hand space, said motion sensor being electrically coupled to said pump;

a power supply being integrated into said vertical wall of said shelf portion of said housing, said power supply being electrically coupled to said motion sensor, said power supply comprising at least one battery;

a stand being positionable on a support surface, said stand comprising:

a base having a top surface, said top surface having a pair of connection points each being integrated into said top surface, said connection points being positioned on opposite sides of said base from each other; and an arm having a first portion slidably engaging a second portion such that said arm has a telescopically adjustable height, said first portion having a bottom end, said second portion having a first section forming an angle with a second section, said first portion slidably engaging said first section such that said second section is oriented perpendicular to said first portion, said second section having a distal end with respect to said first section;

an attachment being coupled to said bottom end of said first portion, said attachment releasably engaging a respective one of said connection points in said top surface of said base;

a screw extending through said first portion of said arm, said screw engaging said first section of said second portion of said arm when said screw is tightened for retaining said arm at a selected height;

a plate having a front surface and a back surface, said back surface being coupled to distal end of said second section of said second portion of said arm, said plate comprising a plurality of arms each radiating outwardly from a center of said plate; and a plurality of fasteners, each of said fasteners comprising a stern extending away from said front surface of said plate and a head being coupled to said stem, said plurality of fasteners being spaced apart from each other and being distributed along a respective one of said arms defined on said plate, said head of each of said fasteners being extendable through said rounded portion of a respective one of said fastener holes in said back side of said outer wall of said reservoir portion of said housing, said stem of each of said fasteners sliding into said channel portion of said respective fastener hole for securing said plate to said back side of said outer wall of said reservoir portion.

* * * * *